US009139992B1

(12) United States Patent
Price

(10) Patent No.: US 9,139,992 B1
(45) Date of Patent: Sep. 22, 2015

(54) FRONT AND SIDE MOUNT TOILET HANDLE TENSIONER

(75) Inventor: Darrell Price, Rockledge, FL (US)

(73) Assignee: Dream Innovation Designs, INC., Rockledge, FL (US)

( * ) Notice: Subject to any disclaimer, the term of this patent is extended or adjusted under 35 U.S.C. 154(b) by 375 days.

(21) Appl. No.: 13/470,656

(22) Filed: May 14, 2012

Related U.S. Application Data

(60) Provisional application No. 61/490,769, filed on May 27, 2011.

(51) Int. Cl.
*E03D 1/00* (2006.01)
*E03D 1/14* (2006.01)

(52) U.S. Cl.
CPC ..... *E03D 1/14* (2013.01)

(58) Field of Classification Search
CPC ..... E03D 1/14; E03D 1/32
USPC ..... 4/405, 410–415
See application file for complete search history.

(56) References Cited

U.S. PATENT DOCUMENTS

| | | | | | |
|---|---|---|---|---|---|
| 3,095,577 | A | * | 7/1963 | Clark | 4/333 |
| 4,416,854 | A | * | 11/1983 | Nielsen | 210/748.18 |
| 4,455,694 | A | | 6/1984 | Dymon | |
| 5,067,180 | A | * | 11/1991 | Figeroid | 4/326 |
| 5,195,190 | A | | 3/1993 | Nguyen-Huu | |
| 5,232,011 | A | * | 8/1993 | Royalty | 137/410 |
| 5,341,522 | A | | 8/1994 | Munro | |
| 6,092,245 | A | * | 7/2000 | Jones | 4/412 |

* cited by examiner

*Primary Examiner* — Paul R Durand
*Assistant Examiner* — Nicholas Ros
(74) *Attorney, Agent, or Firm* — Brian S. Steinberger; Law Offices of Brian S. Steinberger, P.A.

(57) ABSTRACT

Clamp or clip on tensioning attachments, devices, apparatus and methods that mount to a toilet water tank reservoir. The tensioning attachments place downward pressure and tension on the toilet handle arm inside of the tank to prevent the internal flapper from being stuck in a raised position which causes the toilet to be constantly running after being flushed and also keeping tension on the handle arm which keeps the arm rigid not allowing it to loosen which in turn can cause the flapper chain to get hung up in the arm when the arm is lose causing the flapper not to seal as intended. Cleaner adapters can hang from the tensioner devices to clean water inside of the toilet bowl.

16 Claims, 8 Drawing Sheets

10
14
12
18
20
24
28
1
30
40
40
45

100

10
20
130

FRONT AND SIDE MOUNT TOILET HANDLE TENSIONER

This invention claims the benefit of priority to U.S. Provisional Patent Application Ser. No. 61/490,769 filed May 27, 2011.

FIELD OF INVENTION

This invention relates to toilets, in particular to a clip on attachments, devices, apparatus and methods that mount to a toilet water tank reservoir that places downward pressure and tension on the toilet handle arm inside of the tank in order to prevent the flapper from being stuck in a raised position which causes the toilet to be constantly run after being flushed, and also keeps the toilet lever arm rigid and not allowing it to move around in the tank when the water is being released into the toilet bowl which in turn causes the flapper valve chain to get tangled around the toilet lever arm and in turn keeping the flapper valve open and water to run continuous.

BACKGROUND AND PRIOR ART

Toilets are generally known as the primary fixture for water leakage. Running toilets are a constant problem that often occur from flushing a toilet over long periods of time. During the flushing of most toilets, the exterior handle is pushed down, causing an inside attached reservoir handle arm to pivot upward raising a flapper, which releases water into the toilet bowl. After the flushing action, the flapper is supposed to close down, allowing the internal reservoir to refill up for the next flushing action. The refilling of water will stop running after a shut off valve is activated by a float inside the reservoir that reaches a predetermined filled level. Over long periods of repeatedly flushing the toilet, the handle arm can get stuck in a raised position. Additionally, the handle arm can loosen up over time which makes the handle arm loose. The arm in turn can get hung up in the chain which in effect can cause the flapper to not close and results in causing water to constantly run into the toilet bowl from the raised flapper since the reservoir is not able to be filled up.

In addition the flapper can get stuck up if the external handle is stuck in a down position as well, causing the flapper to remain raised, and also result in causing water to constantly run into the toilet bowl from the raised flapper since the reservoir is not able to be filled up.

This constant running of wasted water will obviously cause extra undue expenses in one's water and sewer bill over time. A toilet left running all day can run through up to approximately 4,800 gallons. A water loss of thousands of gallons can overload the septic tank and flood the drain field. It only takes a few hours for such events to devastate a septic tank. Such events will require extensive cleanup and repair costs to both the tank and the drain field. A single toilet's continual demand for water can also overburden the water supply pump, resulting in burnout and repair or replacement. The constant running water can be a sound annoyance noise to those around it.

The current popular solution to fix a running toilet has always been to jiggle the handle. Jiggling the handle is not so much a solution as it is a band aid, since it does not prevent the arm handle from being raised to high.

Another temporary solution is when the user tries to artificially bend the internal handle arm downward, or try to shorten the chain that is attached to the end of the pivoting handle arm. However, these parts are often connected to plastic or easily breakable parts, and the like, which can become easily damaged. Such damage often results in the user replacing internal parts in the toilet or calling a plumber. Hiring a plumber will result in expensive labor and material costs as well.

A still another attempt to deal with toilet water conservation is to purchase a low volume toilet that runs up to approximately 1.6 gallons per flush as compared to up to approximately 4 to 7 gallons per flush with conventional toilets. However, the low volume toilets can be twice as expensive or more as regular toilets, and they still are subject to the same running problems described above.

Thus, the need exists for a solution to the above problems.

SUMMARY OF THE INVENTION

A primary objective of the present invention is to provide clips, devices, apparatus, and methods of preventing a toilet from constantly running by a flapper stuck in a raised position or the flapper chain getting hung up due to a loose handle arm.

A secondary objective of the present invention is to provide clips, devices, apparatus, and methods of preventing a toilet from constantly running by putting tension on a pivoting toilet handle arm.

A third objective of the present invention is to provide clips, devices, apparatus, and methods of preventing a toilet from constantly running by clipping an attachment to an upper edge of toilet reservoir tank.

The handle tensioner is designed to put tension on the handle arm so that after one pushes the external flushing handle down to flush the toilet, so that it returns the handle in the down position, so it never gets hung up in the up position.

The tensioner prevents the handle arm from being stuck in the up position and also makes the handle arm rigid so it does not get loose and allowing the chain to get hung up in the handle arm due to the looseness of the arm which causes the flapper to stick in the up position as well and in turn causes water to continue to run in the toilet because the flapper can't seal. The handle arm tensioner will stop the flapper from remaining in an open position since it keeps the toilet lever arm in the downward position and also makes the handle arm rigid from the tension on the arm so it is does not allow the flapper chain to get hung up in the arm after it is flushed due to a loose handle and movement of the toilet handle arm in the water during the flushing of the toilet and in turn allowing the flapper to seal as intended.

A toilet reservoir mounted toilet handle tensioner device can include an elongated member having a first end and a second end, a clamp on the first end for clamping the elongated member to an upper edge of a toilet reservoir tank, and a free end on the second end, for abutting against an upper surface portion of an internal toilet handle arm, for preventing the toilet handle arm from rising above a predetermined level, which results in preventing a toilet from constantly running after being flushed and also keeping tension on the handle arm which keeps the arm rigid not allowing it to loosen which in turn can cause the flapper chain to get hung up in the arm when the arm is loose causing the flapper not to seal as intended.

The clamp can include a first U shape with a downwardly facing opening for clamping about the upper edge of the toilet reservoir tank, and a second U shape with an upwardly facing opening attached between the first U shape and the first end of the elongated member.

The clamp can be side mounted to the toilet reservoir tank. The side mounted toilet handle tensioner can include at least one score line adjacent to the free end for allowing the elongated member to be shortened for different sized toilet reservoir tanks.

The clamp can be front mounted to the toilet reservoir tank. The front mounted toilet handle tensioner device can be a downwardly angled bent free end.

The downwardly angled bent free end can be a grooved end for fitting about the portion of the upper surface portion of an internal toilet handle arm.

The tensioner device can include a flexible line having an upper end attached to the elongated member adjacent to the first end of the elongated member, and the flexible line having a lower end, and a cleaning member attached to the lower end of the flexible line, so that the cleaning member is in contact with water in the reservoir.

The tensioner device can include a flexible line having an upper end attached to the second U shaped member that is adjacent to the first end of the elongated member, and the flexible line having a lower end, and a cleaning member attached to the lower end of the flexible line, so that the cleaning member is in contact with water in the reservoir.

The elongated member can be formed from aluminum. The elongated member can be formed from molded plastic.

A method for eliminating a toilet handle arm in a toilet from remaining stuck in a raised position after the toilet is flushed can include the steps of providing a tensioner having a clamp end and an elongated member with a free end extending out from the clamp end, clamping the clamp end of an elongated member to an upper edge of a toilet bowl, positioning the free end of the elongated member to push down on a handle arm that is connected to a flusher handle of a toilet, and preventing the handle arm from rising after the flush handle has been pushed down to flush the toilet.

The method can include the step of providing the flush handle be a front flush handle on the toilet. The method can include the step of providing the flush handle be a side mounted flush handle on the toilet. The method can include the step of providing the free end of the elongated member to include a groove. The method can include the step of providing the free end of the elongated member to include a fork. The method can include the step of providing the free end of the elongated member to a plurality of score lines. The method can include the step of providing an upright U shape adjacent to the clamp end. The method can include the steps of hanging a cleaner from the upright U shape, and cleaning water inside the toilet with the cleaner.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
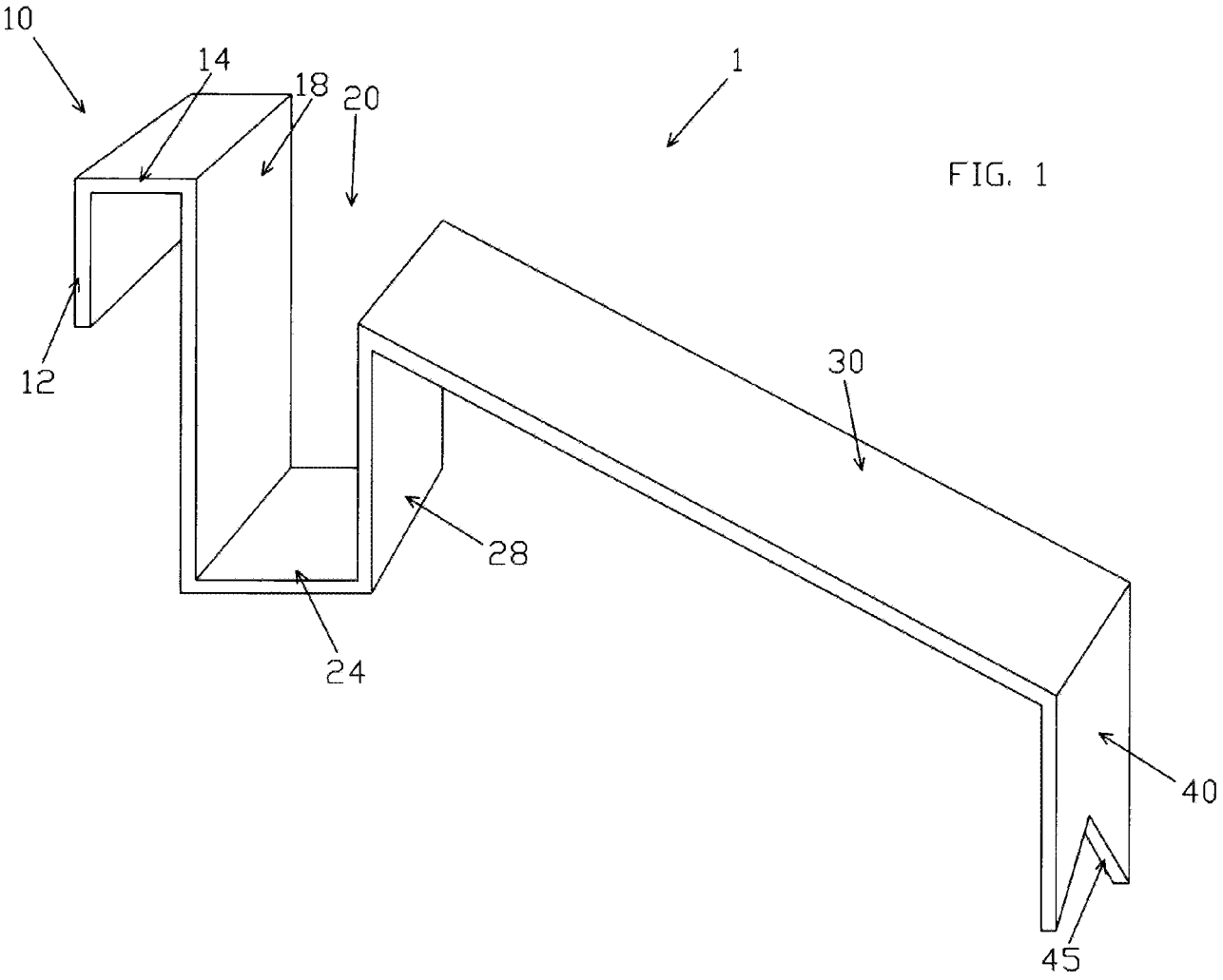
FIG. 1 is a perspective view of a front mount toilet handle tensioner device.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components will now be described.

1. toilet handle tensioner
10. clamp end with inverted U shape
12. outer short vertical leg
14. horizontal leg
18. second long vertical leg of inverted U shape & first long leg of upright U shape
20. upright U shape
24. horizontal leg
28. second vertical leg of upright U shape
30. angled down elongated member
40. downwardly angled bent free end.
45. groove fitting about upper surface portion of an internal toilet handle arm
100. Side mount toilet tensioner
130. angled down elongated member
140. score lines
142. first score line
144. second score line
146. third score line
148. fourth score line
200. toilet bow cleaner adapter
210. line(chain or tie line)
220. mesh bag
225. cleaner insert(cube or other type of cleaner)
300. existing toilet with front flush handle
310. existing reservoir tank
315. upper edge of reservoir tank
318. toilet bowl lid
320. existing flush handle

Figures 2, 2A, 2B:
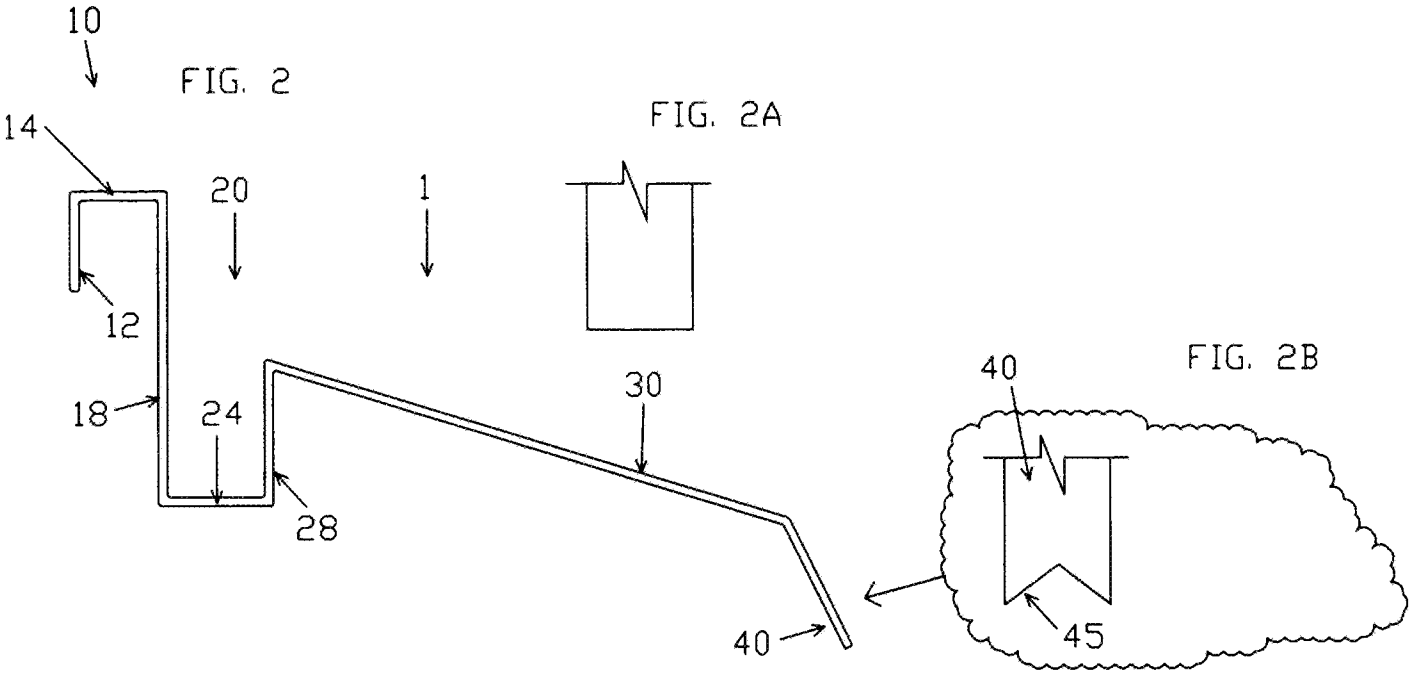
FIG. 2 is a side view of the front mount toilet handle tensioner device of FIG. 1.
FIG. 2A is a partial view of the front mount toilet handle tensioner device of FIG. 2.
FIG. 2B is a partial view of the free end of the toilet handle tensioner device of FIG. 2.

330. existing handle arm
340. existing flapper chain
350. existing flapper
360. existing float
400. existing toilet with side flush handle
410. existing reservoir tank
415. upper edge of reservoir tank
420. existing flush handle
430. existing handle arm
440. existing flapper chain
450. existing flapper FIG. 1 is a perspective view of a front mount toilet handle tensioner device 1. FIG. 2 is a side view of the front mount toilet handle tensioner device 1 of FIG. 1. FIG. 2A is a partial view of the front mount toilet handle tensioner device 1 of FIG. 2. FIG. 2B is a partial view of the free end of the toilet handle tensioner device 1 of FIG. 2.

Referring to FIGS. 1-2B, the tensioner device 1 can be formed from a generally flat elongated aluminum type plate member that can be approximately 1/16" in thickness with a width of approximately ¾". Tensioner device 1 can a clamp end 10 and a free end 40. The clamp end 10 can fit about an upper edge of a toilet tank. The clamp end 10 can have an inverted U shape with outer short vertical leg 12 that can be approximately ¾", a horizontal leg 14 of approximately 9/16" and a second long vertical leg 18 of approximately 1⅝". The vertical leg 18 can also the first long leg of the upright U shape 20, which can have a horizontal leg 24 of approximately ¾" and a second vertical leg 28 of approximately 13/16". The upright U shape 20 can allow for the elongated member 30 having greater bending flexibility when being used.

An angled down elongated member 30, which can be initially angled down at approximately 25 degrees, with a length of approximately 2⅝". At the end of the member 30 can be a downwardly extending bent free end 40 initially angled at approximately 67.5 degrees with a length of approximately 1⅜". The free end 40 can have a forked end or groove 45 which can have a triangular shaped cut-out having an apex approximately 3/16" from the actual end edge of the bend end. The forked edge or groove 45 can be used for partially wrapping about a portion of a toilet handle arm.

Although the U shapes 10 and 20 are shown having generally vertical legs perpendicular to horizontal legs, the vertical legs can be at curves to the horizontal legs. Although aluminum is described, the invention can be used with other types of bendable materials, such as but not limited to galvanized metal, and the like and also plastic materials can be molded and used. Although dimensions are given above from a working model of the tensioner, the tensioner dimensions can vary as needed to those skilled in the art. Additionally, the tensioner device 1 can use other material other than flat metal strips. For example, the side profile shape shown in FIG. 1 can be formed from metal wire and the like.

Figure 3:
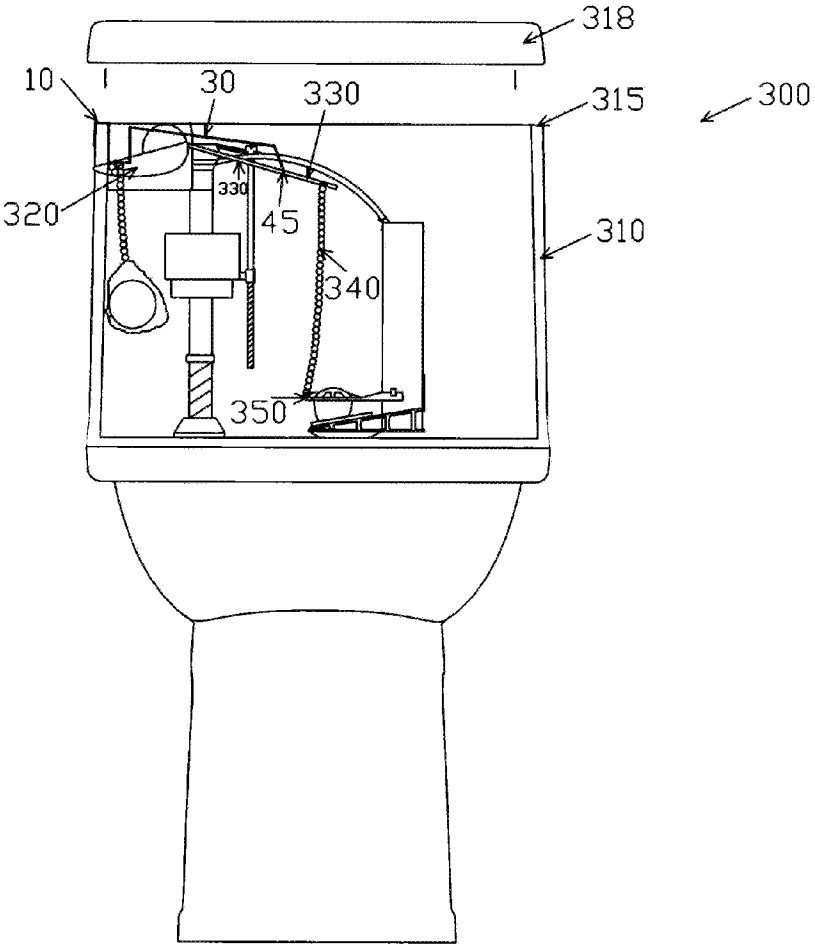
FIG. 3 is a side assembled view of the front mount toilet handle tensioner device of FIG. 1 clamped to an upper edge of a toilet reservoir tank, with the forked free end providing tension to prevent the internal toilet handle arm from raising to high and also keeping tension on the handle arm which keeps the arm rigid not allowing it to loosen which in turn can cause the flapper chain to get hung up in the arm when the arm is loose causing the flapper not to seal as intended.

FIG. 3 is a side assembled view of the front mount toilet handle tensioner device 1 of FIG. 1 mounted inside an existing toilet 300. The tensioner device 1 can be used with 1 an existing toilet 300 that can have a reservoir tank 310, upper edge 315, lid 318. A pivotable front facing flush handle 320 can be attached to a handle arm 330, the end of which is attached to the top of a flapper chain 340, and the bottom of which can be attached to a flapper 350.

The clamp 10 of the tensioner device 1 can be clamped to an upper edge 315 of a toilet reservoir tank 310 and held in place by the toilet lid 318. When the handle 320 is being flushed by being pushed down, the tensioner device 1 has the elongated member 30, with the forked free end 45 providing tension to prevent the internal toilet handle arm 330 from raising to high. The tensioner device 1 is used for keeping tension on the handle arm 330 which keeps the arm 330 rigid not allowing it to loosen which in turn can cause the flapper chain 340 to get hung up in the arm when the arm is lose causing the flapper 350 not to seal as intended.

The tensioner 1 is designed to put tension on the toilet handle arm 330 so after you push the flush handle 320 down to flush the toilet 300, it returns the toilet handle arm 330 in the down position so that the handle arm 330 never gets hung up in the up position. Without the tensioner device 1, if the handle arm 330 gets hung up in the up position then water will continue to run in the toilet 300 because the flapper 350 can't seal. The novel tensioner 1 will stop this from happening because the tensioner keeps the toilet handle arm 330 in the downward position after the toilet 300 has been flushed, and in turn allows the flapper 350 to seal as intended.

Figure 4:
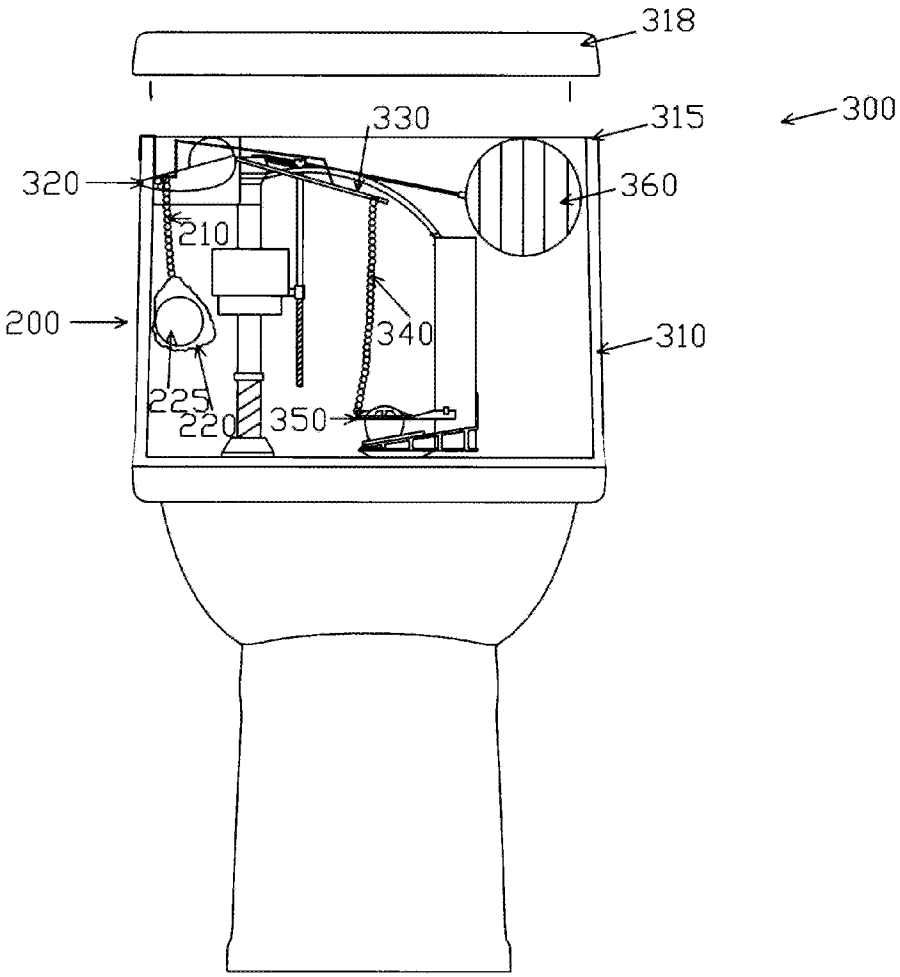
FIG. 4 is another view of the front mount toilet handle tensioner device of FIG. 1 clamped to an upper edge of a toilet tank as in FIG. 3 with an optional chain/tie wrap with hanging mesh bag that can house a cleaner for water stored in the reservoir tank.

FIG. 4 is another view of the front mount toilet handle tensioner device 1 of FIG. 1 clamped to an upper edge 315 of a toilet tank 310 as in FIG. 3 with an optional toilet bowl cleaner adapter 200. A chain/tie wrap or line 210 can be attached to the lower horizontal member 24 of the upright U shape 20 of the tensioner(see FIGS. 1-2). Attached to the lower end of the strand/chain/line 210 can be a hanging mesh bag 220 that can support a cleaner 225, such as but not limited to a cleaner disc or cube or other type of toilet cleaner, to clean water stored in the reservoir tank 310. The novel adapter 200 can keep the cleaner 225 in a secure area so that the hanging bag 220 will not get hung up in the mechanical parts inside of the toilet reservoir tank 310 and will allow any moving mechanical parts to not get jammed due to the cleaner bag 220 and hanging chain/line 210. The mesh bag 220 will allow for the cleaner 225 to be released inside the toilet reservoir tank 310 when water is in the reservoir tank 310. The novel cleaner adapter 200 and its location allows for easy removal and replacement of the cleaner 225 when needed.

Figure 5:
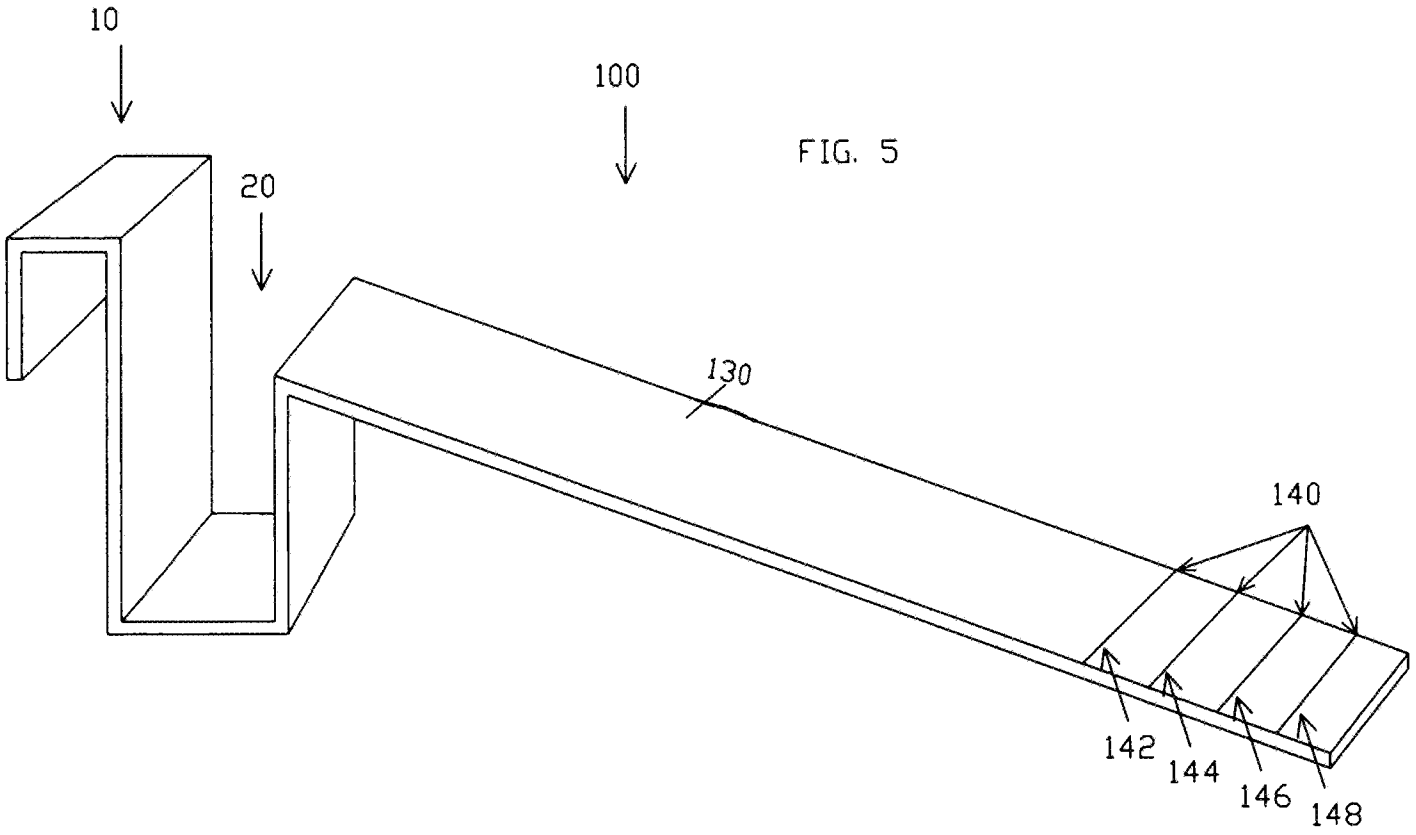
FIG. 5 is a perspective view of a side mounted toilet handle tensioner device with score lines that allow for the free end of the tensioning member to be cut off for different sized toilet tanks.
Figures 6, 6A:
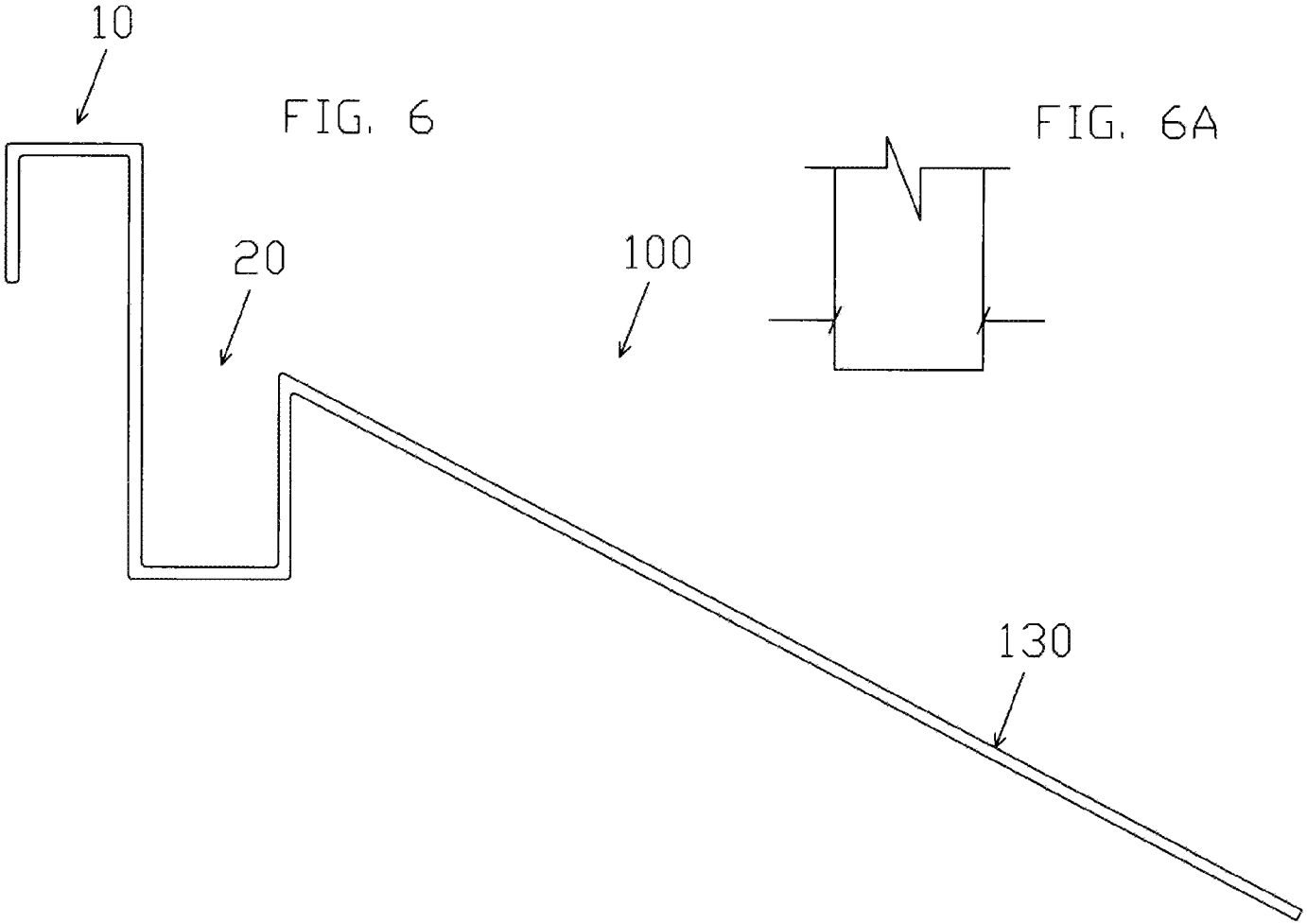
FIG. 6 is a side view of the side mounted toilet handle tensioner device of FIG. 5.
FIG. 6A is a partial view of the side mount toilet handle device of FIG. 6.

FIG. 5 is a perspective view of a side mounted toilet handle tensioner device 100 with score lines 140 that allow for the free end of the tensioning member to be cut off for different sized toilet tanks. One or more score lines 142, 144, 146, 148 can be spaced approximately ½ inch apart from one another. FIG. 6 is a side view of the side mounted toilet handle tensioner device 100 of FIG. 5. FIG. 6A is a partial view of the side handle tensioner device 100 of FIG. 6.

Referring to FIGS. 5-6A, the side mounted tensioner device 100 can include similar clamp end 10 with inverted U shape, and upright U shape 20, that connects to another elongated member 130 that can have a length of approximately 6" and be angled down approximately 32.5 degrees. At the end of the member 130 can be score lines 140, that can include score line 142, score line 144, score line 146 and score line 148. Each of the score lines 142, 144, 146, 148 can allow for the end of the elongated member 130 to be broken off with a pair of pliers, and the like, to shorten the elongated member 130 when needed to fit into a toilet reservoir tank. The score lines shown 142, 144, 146, 148 can be spaced apart approximately ½" from one another.

Figure 7:
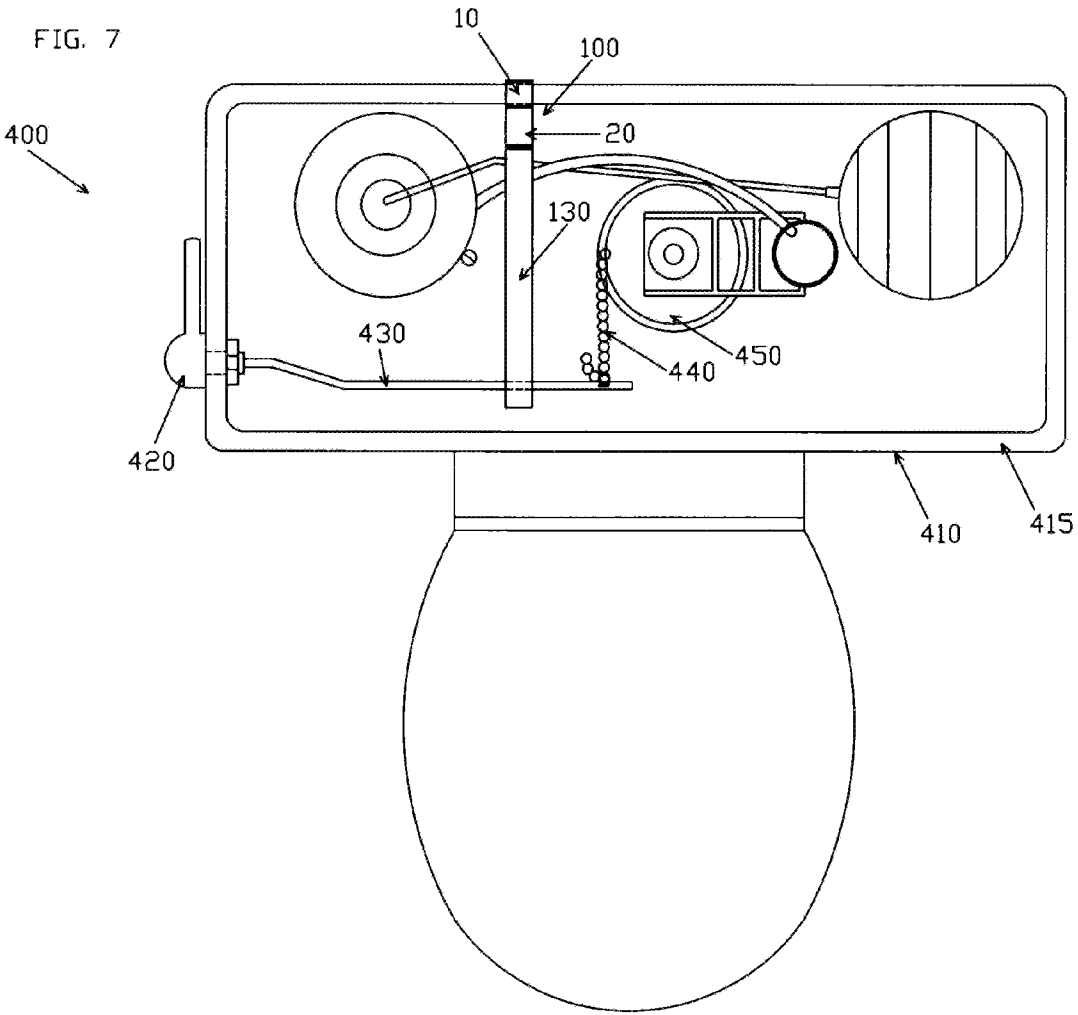
FIG. 7 is an upper assembled view of the side mounted tensioner device of FIG. 5 clamped to an upper edge of a toilet reservoir tank, with the free end providing tension to prevent the internal toilet handle arm from raising to high and also keeping tension on the handle arm which keeps the arm rigid not allowing it to loosen which in turn can cause the flapper chain to get hung up in the arm when the arm is lose causing the flapper not to seal as intended.

FIG. 7 is an upper assembled view of the side mounted tensioner device 100 of FIG. 5 clamped to an upper edge 415 of a toilet reservoir tank 410 of a toilet 400 with side handle 420. The free end of the elongated member 130 can provide downward tension to prevent the internal toilet handle arm 430 from raising to high after the side handle is pushed down to flush the toilet. The free end of the elongated member 130 can also keep tension on the handle arm 430 which keeps the arm 430 rigid not allowing it to loosen which in turn can cause the flapper chain 440 to get hung up in the arm 430 when the arm 430 is loose causing the flapper 450 not to seal as intended.

Figure 8:
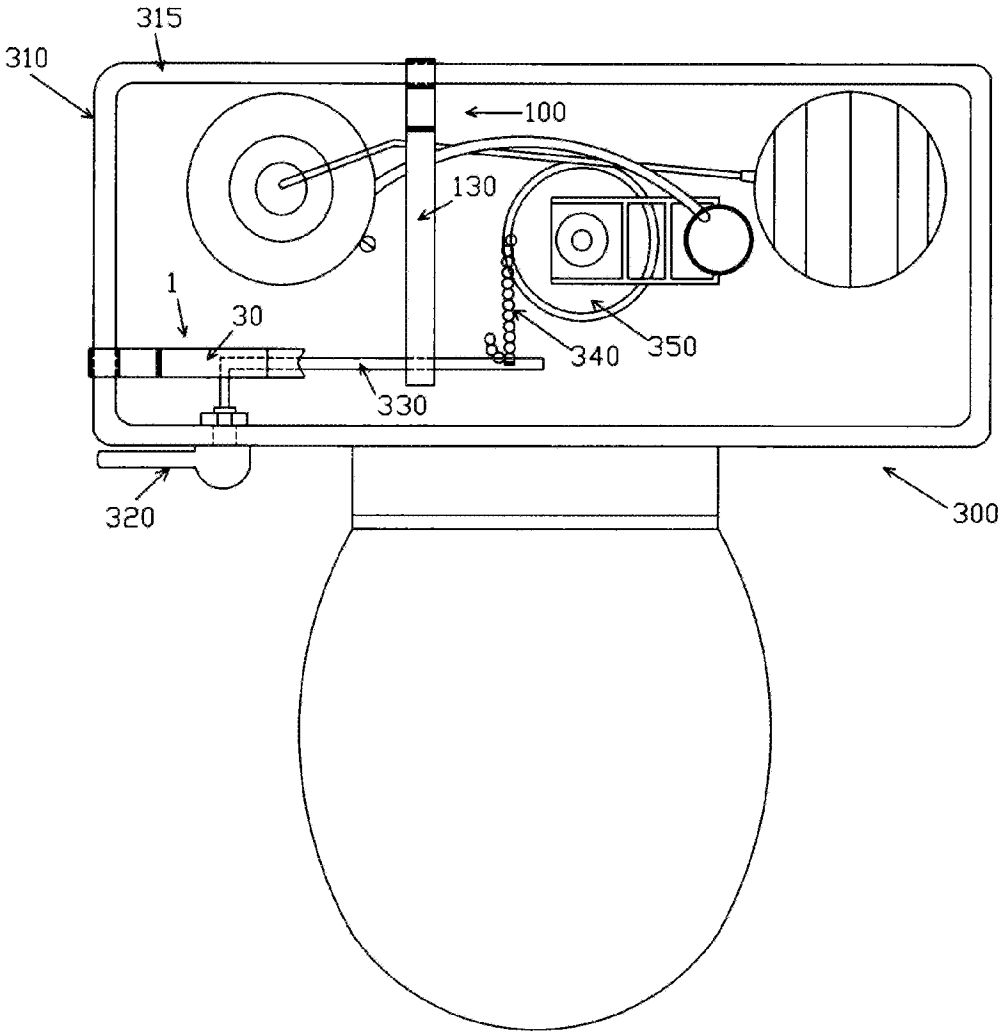
FIG. 8 is another upper view showing both the front mounted toilet handle tensioner device or the side mounted toilet handle tensioner device able to be mounted on a front handle toilet.

FIG. 8 is another upper view showing both the front mounted toilet handle tensioner device 1 or the side mounted toilet handle tensioner device 100 able to be mounted on a front handle toilet 300. Here, the tensioner device 1 is shown mounted as in FIGS. 3-4. Alternatively the side mounted tension device 100 can be clamped to a rear edge 315 of the tank 310 with the free end of the elongated member 130 pushing down on the toilet handle arm 330 which will function similar to FIG. 7.

Although, a preferred device is formed from aluminum, other types of materials can be used such as but not limited to galvanized metal, and the like. In addition, the tensioning device can be formed form injection molded plastic, and the like.

A rubber or plastic coating, and the like, can be on the clamp and/or on the free end of the tensioner devices, as needed to enhance attaching to the reservoir tank and to contact the toilet handle arm.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A toilet reservoir mounted toilet handle tensioner device, comprising:

an elongated member having a first end and a second end;

a clamp on the first end for clamping the elongated member to an upper edge of a toilet reservoir tank, the clamp includes a first U shape with a downwardly facing opening for clamping about the upper edge of the toilet reservoir tank, and a second U shape with an upwardly facing opening attached between the first U shape and the first end of the elongated member; and a free end on the second end, for abutting against an upper surface portion of an internal toilet handle arm, for preventing the toilet handle arm from rising above a predetermined level, which results in preventing a toilet from constantly running after being flushed and also keeping tension on the handle arm which keeps the arm rigid not allowing it to loosen which in turn can cause the flapper chain to get hung up in the arm when the arm is loose lose causing the flapper not to seal as intended.

2. The toilet reservoir mounted toilet handle tensioner device of claim 1, further comprising:

a flexible line having an upper end attached to the elongated member adjacent to the first end of the elongated member, and the flexible line having a lower end; and a cleaning member attached to the lower end of the flexible line, so that the cleaning member is in contact with water in the reservoir.

3. The toilet reservoir mounted toilet handle tensioner device of claim 1, wherein the elongated member is formed from aluminum.

4. The toilet reservoir mounted toilet handle tensioner device of claim 1, wherein the elongated member is formed from molded plastic.

5. The toilet reservoir mounted toilet handle tensioner device of claim 1, wherein the clamp is front mounted to the toilet reservoir.

6. The toilet reservoir mounted toilet handle tensioner device of claim 5, wherein the front mounted toilet handle tensioner device includes:

a downwardly angled bent free end.

7. The toilet reservoir mounted toilet handle tensioner device of claim 6, wherein the downwardly angled bent free end includes:

a grooved end for fitting about the portion of the upper surface portion of an internal toilet handle arm.

8. A method for eliminating a toilet handle arm in a toilet from remaining stuck in a raised position after the toilet is flushed comprising the steps of:

providing a tensioner having a clamp end and an elongated member with a free end extending out from the clamp end;

providing an upright U shape adjacent to the clamp end clamping the clamp end of an elongated member to an upper edge of a toilet bowl;

positioning the free end of the elongated member to push down on a handle arm that is connected to a flusher handle of a toilet; and preventing the handle arm from rising after the flush handle has been pushed down to flush the toilet.

9. The method of claim 8, further comprising the step of:

providing the flush handle be a front flush handle on the toilet.

10. The method of claim 8, further comprising the step of:

providing the flush handle be a side mounted flush handle on the toilet.

11. The method of claim 8, further comprising the step of:

providing the free end of the elongated member to include a groove.

12. The method of claim 8, further comprising the step of:

providing the free end of the elongated member to include a fork.

13. The method of claim 8, further comprising the steps of:

hanging a cleaner from the upright U shape; and cleaning water inside the toilet with the cleaner.

14. A toilet reservoir mounted toilet handle tensioner device, comprising:

an elongated member having a first end and a second end;

a clamp on the first end for clamping the elongated member to an upper edge of a toilet reservoir tank, the clamp includes a first U shape with a downwardly facing opening for clamping about the upper edge of the toilet reservoir tank, and a second U shape with an upwardly facing opening attached between the first U shape and the first end of the elongated member, wherein the clamp is side mounted to the toilet reservoir; and a free end on the second end, for abutting against an upper surface portion of an internal toilet handle arm, for preventing the toilet handle arm from rising above a predetermined level, which results in preventing a toilet from constantly running after being flushed and also keeping tension on the handle arm which keeps the arm rigid not allowing it to loosen which in turn can cause the flapper chain to get hung up in the arm when the arm is loose causing the flapper not to seal as intended, and wherein the elongated member includes at least one score line adjacent to the free end for allowing the elongated member to be shortened for different sized toilet reservoir tanks.

15. A method for eliminating a toilet handle arm in a toilet from remaining stuck in a raised position after the toilet is flushed comprising the steps of:

providing a tensioner having a clamp end and an elongated member with a free end extending out from the clamp end; providing an upright U shape adjacent to the clamp end;

providing the free end of the elongated member with a plurality of score lines;

clamping the clamp end of an elongated member to an upper edge of a toilet bowl;

positioning the free end of the elongated member to push down on a handle arm that is connected to a flusher handle of a toilet; and preventing the handle arm from rising after the flush handle has been pushed down to flush the toilet.

16. A toilet reservoir mounted toilet handle tensioner device, comprising:

an elongated member having a first end and a second end;

a clamp on the first end for clamping the elongated member to an upper edge of a toilet reservoir tank, the clamp includes a first U shape with a downwardly facing opening for clamping about the upper edge of the toilet reservoir tank, and an upwardly facing opening attached between the first U shape and the first end of the elongated member; and a free end on the second end, for abutting against an upper surface portion of an internal toilet handle arm, for preventing the toilet handle arm from rising above a predetermined level, which results in preventing a toilet from constantly running after being flushed and also keeping tension on the handle arm which keeps the arm rigid not allowing it to loosen which in turn can cause the flapper chain to get hung up in the arm when the arm is loose causing the flapper not to seal as intended.

* * * * *